US005986293A

United States Patent [19]

Suzuki et al.

[11] Patent Number: 5,986,293

[45] Date of Patent: Nov. 16, 1999

[54] SEMICONDUCTOR INTEGRATED CIRCUIT DEVICE WITH VOLTAGE PATTERNS

[75] Inventors: Takaaki Suzuki; Hirohiko Mochizuki; Masao Taguchi, all of Kawasaki, Japan

[73] Assignee: Fujitsu Limited, Kawasaki, Japan

[21] Appl. No.: 08/931,935

[22] Filed: Sep. 17, 1997

Related U.S. Application Data

[62] Division of application No. 08/722,934, Sep. 30, 1996, Pat. No. 5,757,226, which is a continuation of application No. 08/377,229, Jan. 24, 1995, abandoned.

[30] Foreign Application Priority Data

Jan. 28, 1994 [JP] Japan ..... 6-008542
Apr. 25, 1994 [JP] Japan ..... 6-086697

[51] Int. Cl.[6] ..... H01L 27/10

[52] U.S. Cl. ..... 257/203; 257/207; 257/296; 257/659; 257/773

[58] Field of Search ..... 257/659, 203, 257/207, 773, 296

[56] References Cited

U.S. PATENT DOCUMENTS

| | | | |
|---|---|---|---|
| 4,064,448 | 12/1977 | Eatock | 323/313 |
| 4,514,749 | 4/1985 | Shoji | 257/659 X |
| 5,103,158 | 4/1992 | Cho et al. | 323/314 |
| 5,132,565 | 7/1992 | Kuzumoto | 327/541 |
| 5,160,997 | 11/1992 | Sandoh et al. | 257/659 X |
| 5,180,988 | 1/1993 | McDaniel | 330/282 |
| 5,352,973 | 10/1994 | Audy | 323/313 |
| 5,428,242 | 6/1995 | Furuya et al. | 257/659 X |
| 5,616,952 | 4/1997 | Nakano et al. | 257/659 |

FOREIGN PATENT DOCUMENTS

| | | | |
|---|---|---|---|
| 63-265524 | 11/1988 | Japan . | |
| 4030470 | 2/1992 | Japan | 257/659 |

OTHER PUBLICATIONS

Paul Horowitz, *The Art of Electronics,* Cambridge University Press, NY, NY, 2nd ed., 1990, pp. 310–311.

Concannon et al., IBM Technical Disclosure Bulletin—"Regulated On–Chip Supply Voltage Source For MOSFET Integrated Circuits", Feb. 1982; pp. 4668–4669.

Hansen, IBM Technical Disclosure Bulletin—"Voltage Regulator", Sep. 1971; p. 1050.

Dorler et al., IBM Technical Disclosure Bulletin—"Constant–Voltage Source", Sep. 1971, p. 1058.

*Primary Examiner*—William Mintel

*Attorney, Agent, or Firm*—Armstrong, Westerman, Hattori, McLeland & Naughton

[57] ABSTRACT

A semiconductor integrated circuit device includes a reference voltage generating circuit outputting a reference voltage from a step-up voltage, a step-up circuit stepping up the reference voltage within a range lower than an external power supply voltage and thus outputting the above step-up voltage, a step-down circuit stepping down the external power supply voltage and thus outputting a step-down voltage equal to the reference voltage, and an internal circuit receiving, as a power supply voltage thereof, the step-down voltage.

10 Claims, 19 Drawing Sheets

SEMICONDUCTOR INTEGRATED CIRCUIT DEVICE WITH VOLTAGE PATTERNS

This application is a divisional of U.S. application Ser. No. 08/722,934 filed on Sep. 30, 1996, now U.S. Pat. No. 5,757,226, which is a continuation of U.S. application Ser. No. 08/377,229, field Jan. 24, 1995, now abandoned.

BACKGROUND OF THE INVENTION

1. Field of the Invention

The present invention generally relates to semiconductor integrated circuit devices, and more particularly to a semiconductor integrated circuit device equipped with a reference voltage generating circuit and a step-down circuit that steps down an external power supply voltage externally supplied and produces a step-down voltage equal to a reference voltage generated by the reference voltage generating circuit.

2. Description of the Related Art

In FIG. 1, there is illustrated an essential part of a related semiconductor integrated circuit device. The device shown in FIG. 1 includes a reference voltage generating circuit 1, a VCC power supply line 2, resistors 3 through 5, enhancement type nMOS (n-channel Metal Oxide Semiconductor) transistors 6 and 7, and depletion type pMOS (p-channel MOS) transistors 8 and 9. The reference voltage generating circuit 1 generates a reference voltage VREF. The VCC power supply line carries an external power supply voltage VCC externally supplied.

The device shown in FIG. 1 also includes a step-down circuit 10, which steps down the external power supply voltage VCC externally supplied. The step-down circuit 10 includes a VCC power supply line 11, an enhancement type pMOS transistor 12 serving as a regulator transistor, and an operational amplifier 13. Symbol VIIA denotes a step-down voltage obtained by stepping down the external power supply voltage VCC.

Further, the device shown in FIG. 1 includes an internal circuit 14, which is operated by a power supply voltage which is the step-down voltage VIIA output by the step-down circuit 10.

The reference voltage generating circuit 1 generates the reference voltage VREF equal to $2\times VTH_{n-E}+2\times|VTH_{n-D}|$ where $VTH_{n-E}$ denotes the threshold voltage of the enhancement type nMOS transistor and $VTH_{n-D}$ denotes the threshold voltage of the depletion type nMOS transistor.

In the step-down circuit 10, the pMOS transistor 12 steps down the external power supply voltage VCC, and the step-down voltage VIIA obtained at the drain of the pMOS transistor 12 is fed back to the inverting input terminal of the operational amplifier 13. The output signal of the operational amplifier 13 controls the gate voltage of the pMOS transistor 12 so that the step-down voltage VIIA equal to the reference voltage VREF can be produced.

It will be noted that the pMOS transistors 8 and 9 forming the reference voltage generating circuit 1 are supplied with the external power supply voltage VCC, while the transistors forming the internal circuit 14 are supplied with the step-down voltage VIIA. The breakdown voltage of the nMOS transistors 8 and 9 will be reduced and the stable operation thereof may not be ensured, if the gate oxide films of the nMOS transistors 8 and 9 are formed by the same process as the gate oxide films of the transistors forming the internal circuit 14 so that the gate oxide films of the nMOS transistors 8 and 9 have the same thickness as that of the transistors forming the internal circuit 14.

If the gate oxide films of the nMOS transistors 8 and 9 are formed so that they are thicker than those of the transistors forming the internal circuit 14, the stability of the operation of the reference voltage generating circuit 1 can be improved. However, the production process will become complex.

There is a case where another reference voltage different from the reference voltage VIIA internally produced is externally applied to the semiconductor integrated circuit device equipped with the reference voltage generating circuit 1 when testing it. In such a case, if the reference voltage externally supplied is higher than the reference voltage VREF generated by the reference voltage generating circuit 1, the externally supplied reference voltage gets over the reference voltage VREF generated by the reference voltage generating circuit 1. Hence, the externally supplied reference voltage higher than the reference voltage VREF can be supplied to the non-inverting input terminal of the operational amplifier 13.

If the reference voltage externally supplied is lower than the reference voltage VREF generated by the reference voltage generating circuit 1, the externally supplied reference voltage cannot get over the reference voltage VREF. Hence, it is impossible to supply, when testing the device, the inverting input terminal of the operational amplifier 13 with the externally supplied reference voltage lower than the reference voltage VREF.

SUMMARY OF THE INVENTION

It is a general object of the present invention to provide a semiconductor integrated circuit device in which the above disadvantages are eliminated.

A more specific object of the present invention is to provide a semiconductor integrated circuit device in which the stable operation of a reference voltage generating circuit can be ensured even when gate oxide films,of transistors forming the reference voltage generating circuit are formed by the same process as those of transistors forming an internal circuit operated with a step-down or reduced voltage derived from an external power supply voltage and are thus equal in thickness thereto and in which a reference voltage lower than the reference voltage generated by the built-in reference voltage generating circuit can be externally applied to an internal circuit.

The above objects of the present invention are achieved by a semiconductor integrated circuit device comprising:

a reference voltage generating circuit outputting a reference voltage from a step-up voltage;

a step-up circuit stepping up the reference voltage within a range lower than an external power supply voltage and thus outputting said step-up voltage;

a step-down circuit stepping down the external power supply voltage and thus outputting a step-down voltage equal to the reference voltage; and an internal circuit receiving, as a power supply voltage thereof, the step-down voltage.

As to an improvement in the supplying of the reference voltage, there is also provided a semiconductor integrated circuit device comprising:

a semiconductor chip;

a reference voltage supply pattern which supplies a reference voltage to a circuit formed on the semiconductor chip; and shield patterns which electrically shield the reference voltage supply pattern, the shield patterns being arranged along the reference voltage supply pattern and being set to a predetermined potential externally supplied, the reference voltage having a level based on the predetermined potential.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
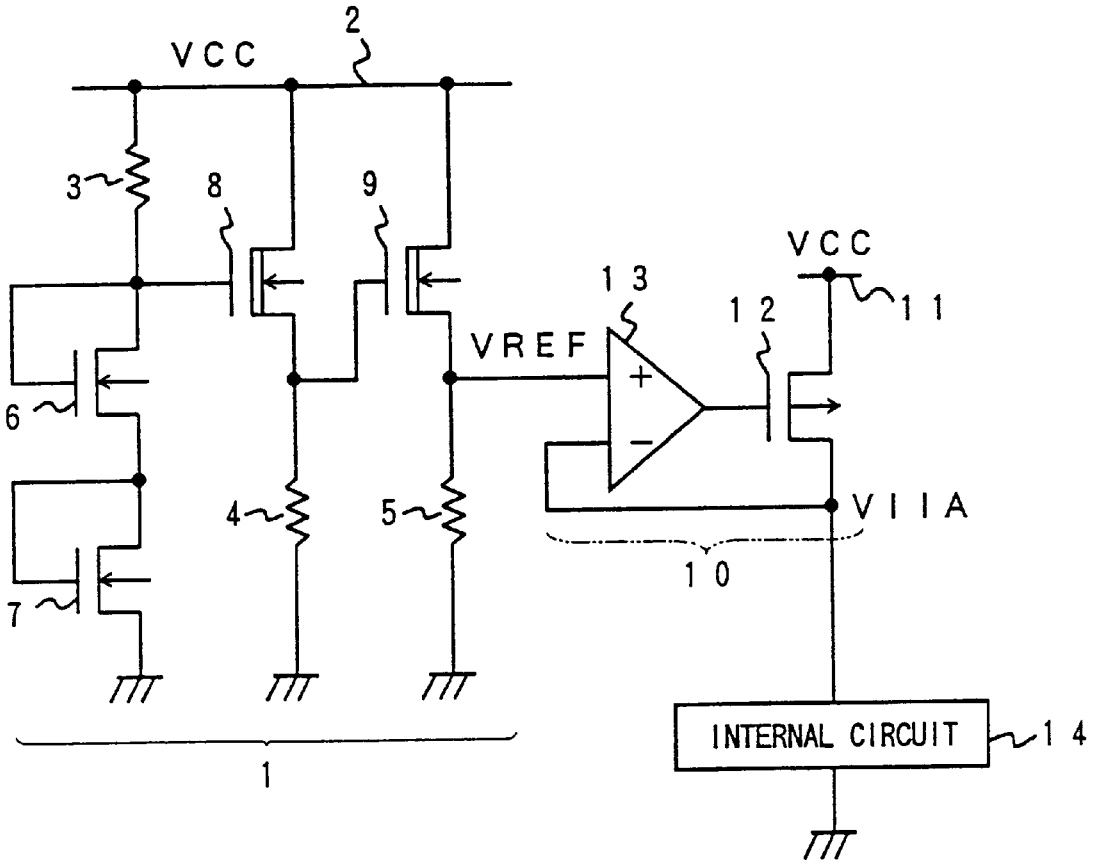
FIG. 1 is a circuit diagram of an essential part of a semiconductor integrated circuit device related to the present invention.
Figure 2:
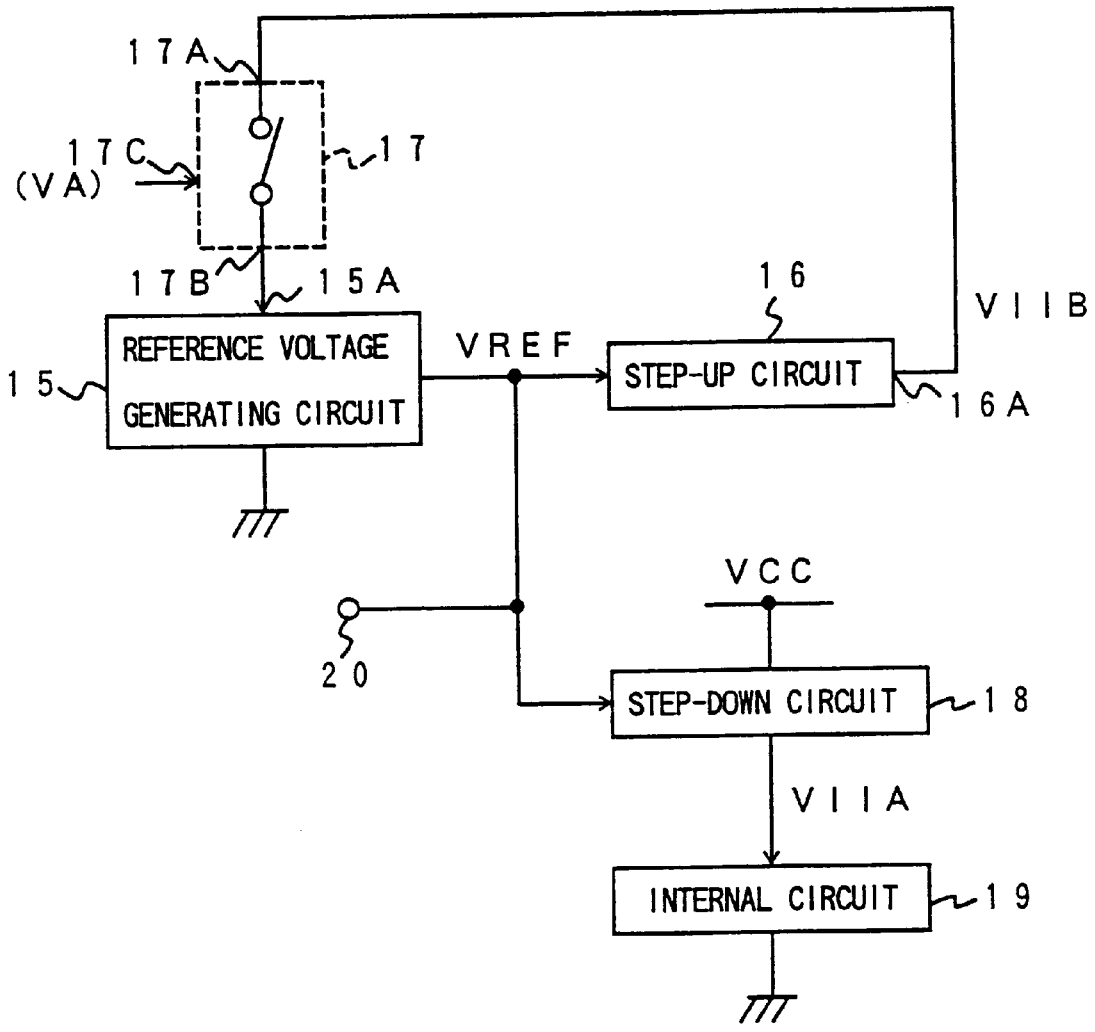
FIG. 2 is a block diagram of the principle of a first embodiment of the present invention.

Referring to FIG. 2, there is illustrated the principle of a semiconductor integrated circuit device according to the first embodiment of the present invention. The semiconductor integrated circuit device shown in FIG. 2 includes a reference voltage generating circuit 15, a step-up circuit 16, a switching element 17, a buffer amplifier circuit 18, and an internal circuit 19 operating with a power supply voltage which is a step-down (reduced) voltage VIIA generated by the buffer amplifier circuit 18.

The reference voltage generating circuit 15 outputs a reference voltage VREF. The step-up circuit 16 steps up the reference voltage VREF output by the reference voltage generating circuit 15 within a range lower than the power supply voltage VCC externally supplied. The switching element 17 has an input terminal 17A connected to a step-up voltage output terminal 16A of the step-up circuit 16, and an output terminal 17B connected to a power supply voltage input terminal 15A of the reference voltage generating circuit 15. In the normal operation, the switching element 17 is put in the conducting state in response to power on. In the test mode, a given voltage VA is applied to a control terminal 17C of the switching element 17, which is thus switched to the non-conducting state. The buffer amplifier circuit 18 steps down the power supply voltage VCC externally supplied, and outputs the step-down voltage VIIA equal to the reference voltage VREF.

In the normal operation, the switching element 17 is in the conducting state. Hence, a step-up voltage VIIB is supplied, as a power supply voltage, to the reference voltage generating circuit 15 via the switching element 17. The step-up circuit 16 steps up the reference voltage VREF within the range lower than the external power supply voltage VCC. Hence, the step-up voltage VIIB is lower than the external power supply voltage VCC. In the above way, the reference voltage generating circuit 15 is made, in the normal operation, to operate with the power supply voltage that is the step-up voltage VIIB lower than the external power supply voltage VCC. Hence, it becomes possible to avoid the unstable operation due to insufficiency of the breakdown voltage for the gate oxide films of transistors forming the reference voltage generating circuit 15 even when the gate oxide films of these transistors are formed by the same process as the gate oxide films of transistors forming the internal circuit 19 which is operated by the step-down voltage VIIA. Hence, it becomes possible to ensure the stable operation of the reference voltage generating circuit 15.

The switching element 17 can be switched to the non-conducting state by applying the given voltage VA to the control terminal 17C of the switching element 17, whereby the reference voltage generating circuit 15 can be made inactive. In the test operation, a reference voltage lower than the reference voltage VREF output by the reference voltage generating circuit 15 can be applied to the step-down circuit 18 via a terminal 20 for external connection.

Figure 3:
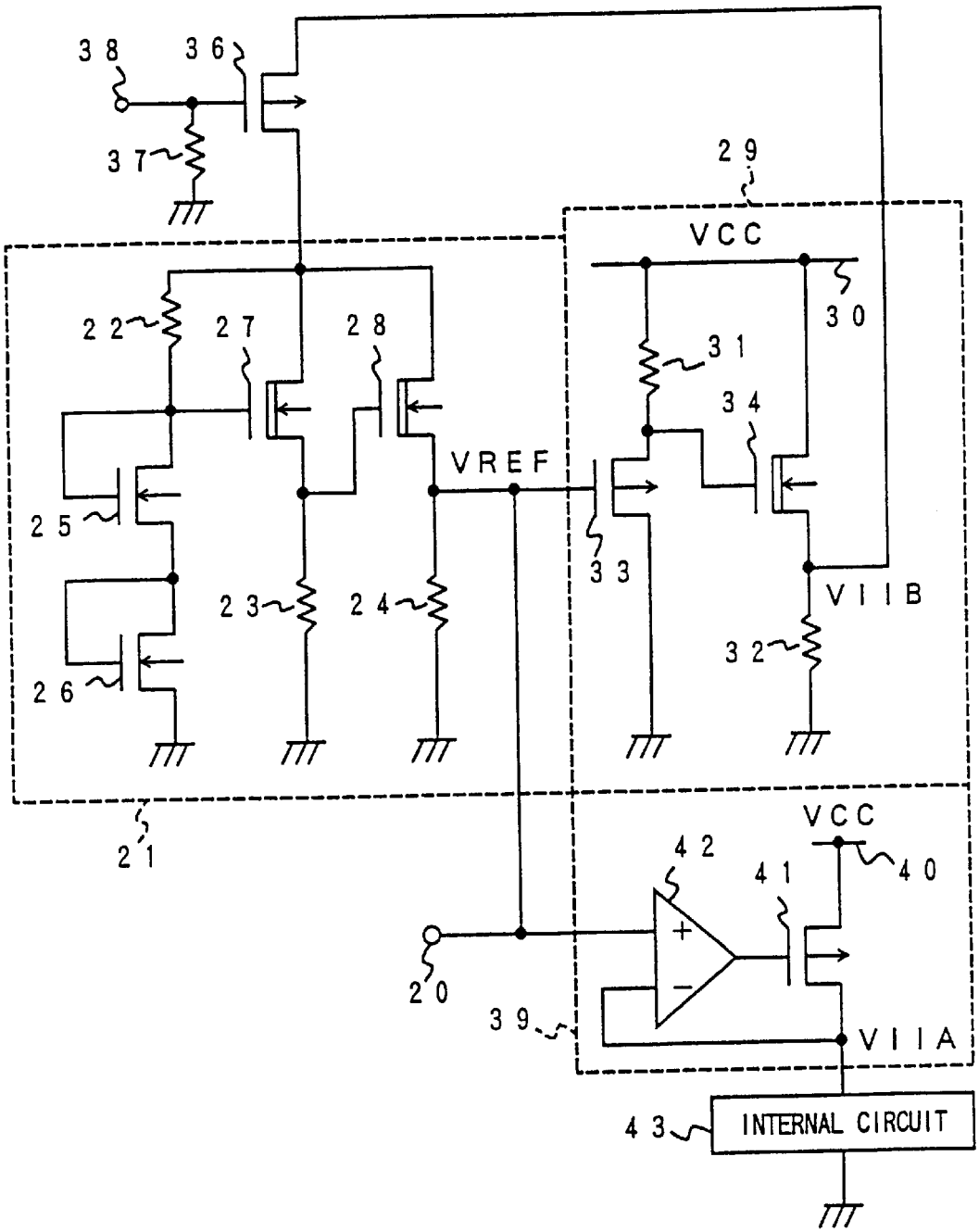
FIG. 3 is a circuit diagram of a semiconductor integrated circuit device according to the first embodiment of the present invention.

FIG. 3 is a circuit diagram of an essential part of the semiconductor integrated circuit device according to the first embodiment of the present invention. The device shown in FIG. 3 includes a reference voltage generating circuit 21, which generates a reference voltage VREF and includes resistors 22 through 24, enhancement type nMOS transistors 25 and 26, and depletion type nMOS transistors 27 and 28.

The device shown in FIG. 3 includes a step-up circuit 29, which steps up the reference voltage VREF output by the reference voltage generating circuit 21, and includes a VCC power supply line 30, resistors 31 and 32, an enhancement type pMOS transistor 33, and a depletion type nMOS transistor 34. The VCC power supply line 30 carries the external power supply voltage. The symbol VIIB denotes the step-up voltage obtained by stepping up the reference voltage VREF.

Further, the device shown in FIG. 3 includes an enhancement type pMOS transistor 36, a resistor 37 and a pad (terminal) 38. Furthermore, the device shown in FIG. 3 includes a step-down circuit 39, which steps down the external power supply voltage VCC. The step-down circuit 39 is made up of a VCC power supply line 40, an enhancement type pMOS transistor 41 serving as a regulator transistor, and an operational amplifier 42. The symbol VIIA denotes a step-up voltage obtained by stepping up the external power supply voltage VCC.

Moreover, the device shown in FIG. 3 includes an internal circuit 43, which is operated by the power supply voltage that is the step-down voltage output by the step-down circuit 39.

The reference voltage generating circuit 21 generates the voltage equal to $2\times VTH_{n-E}+2\times|VTH_{n-D}|$ where $VTH_{n-E}$ denotes the threshold voltage of the enhancement type nMOS transistor and $VTH_{n-D}$ denotes the threshold voltage of the depletion type nMOS transistor as in the case of the reference voltage generating circuit 1.

The step-down circuit 39 steps down the external power supply voltage VCC by means of the pMOS transistor 41. The step-down voltage VIIA obtained at the drain of the pMOS transistor 41 is fed back to the inverting input terminal of the operational amplifier 42. The output signal of the operational amplifier 42 is used to control the gate voltage of the pMOS transistor 41 so that the step-down voltage VIIA equal to the reference voltage VREF can be obtained.

The power supply voltage supplied to the transistors 27 and 28 is not the power supply voltage VCC, which is applied to the transistors 33 and 34. The transistors 27 and 28 are affected by the level of the reference voltage VREF, while the transistors 33 and 34 are not directly associated with production of the reference voltage VREF. Hence, even if the transistors 33 and 34 are slightly degraded, there will be no problem about production of the reference voltage VREF.

Figure 4:
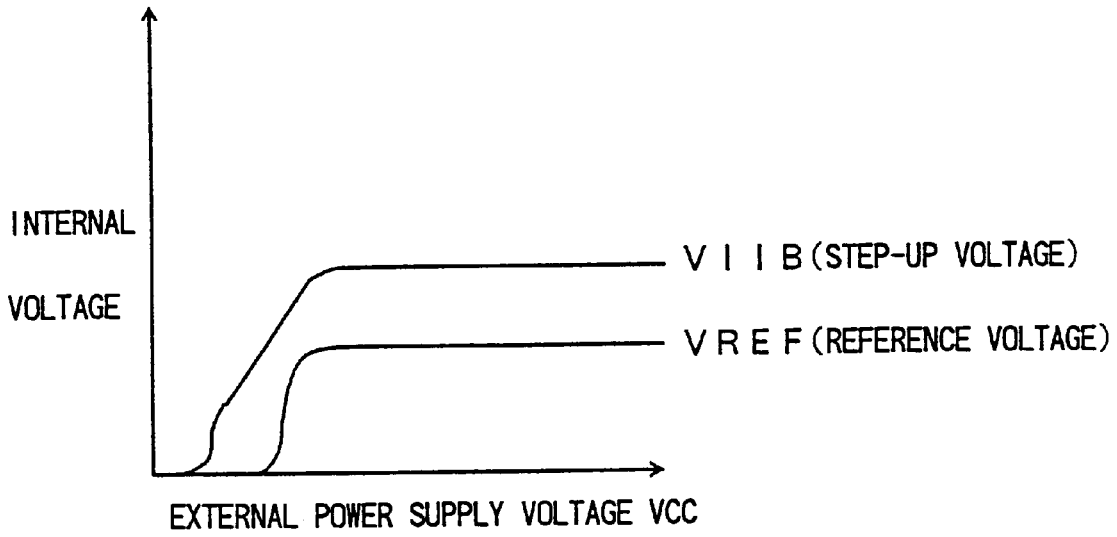
FIG. 4 is a graph of characteristics of a reference voltage generating circuit and a step-up circuit shown in FIG. 3.

FIG. 4 is a graph of the characteristics of the reference voltage generating circuit 21 and the step-up circuit 29. At the commencement of application of the external power supply voltage VCC in the normal operation, the gate voltage of the pMOS transistor 33 of the step-up circuit 29 is set to the ground voltage (0 V) via the resistor 24. Hence, the step-up voltage VIIB equal to $|VTH_{p-E}|+|VTH_{n-D}|$ is generated where $VTH_{p-E}$ denotes the threshold voltage of the enhancement type pMOS transistor and $VTH_{n-D}$ denotes the threshold voltage of the depletion type nMOS transistor.

In this case, the gate voltage of the pMOS transistor 36 is set to the ground voltage 0 V via the resistor 37. Hence, the gate-source voltage $|V_{GS}|$ of the PMOS transistor 36 becomes higher than $|VTH_{p-E}|$, and hence the pMOS transistor 36 is switched to the conducting state. As a result, the voltage $|VTH_{p-E}|+|VTH_{n-D}|$ is supplied to the power supply voltage of the reference voltage generating circuit 21. Hence, the reference voltage VREF is increased and the step-up voltage VIIB is increased. Finally, the reference voltage VREF becomes equal to $2\times VTH_{n-E}+2\times|VTH_{n-D}|$, and the step-up voltage VIIB becomes equal to $VREF+|VTH_{p-E}|+|VTH_{n-D}|$.

As described above, in the normal operation, the reference voltage generating circuit 21 of the first embodiment of the present invention is operated by the power supply voltage that is the step-up voltage VIIB equal to $VREF+|VTH_{p-E}|+|VTH_{n-D}|$ and lower than the external power supply voltage VCC.

Hence, it becomes possible to avoid the unstable operation due to insufficiency of the breakdown voltage for the gate oxide films of the nMOS transistors 27 and 28 even when the gate oxide films of the transistors 25–28 forming the reference voltage generating circuit 21 are formed by the same process as the gate oxide films of the nMOS transistors forming the internal circuit 43 which is operated by the step-down voltage VIIA. Hence, it becomes possible to ensure the stable operation of the reference voltage generating circuit 21.

In the first embodiment of the present invention, the PMOS transistor 36 can be switched to the non-conducting state by applying the external power supply voltage VCC to the pad 38, so that the reference voltage generating circuit 21 can be switched to the non-conducting state. Hence, it becomes possible to supply, in the test operation, the non-inverting input terminal of the operational amplifier 42 of the step-down circuit 39 with the reference voltage lower than the reference voltage VREF output by the reference voltage generating circuit 21.

A description will now be given of a semiconductor integrated circuit device according to a second embodiment of the present invention.

Figure 5:
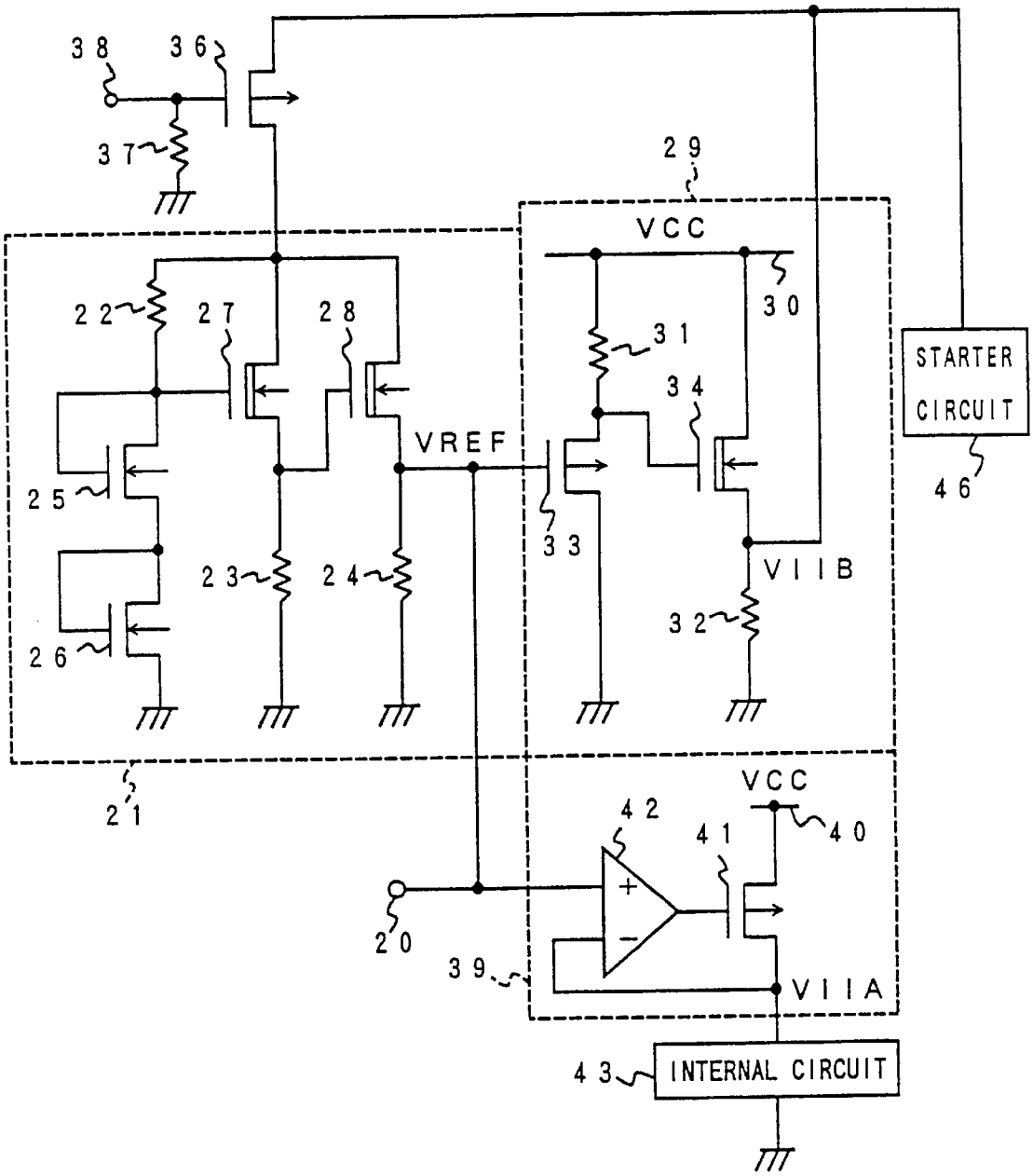
FIG. 5 is a circuit diagram of a semiconductor integrated circuit device according to a second embodiment of the present invention.

FIG. 5 is a circuit diagram of an essential part of the device according to the second embodiment of the present invention, in which parts that are the same as those shown in the previously described figures are given the same reference numbers. The device shown in FIG. 5 can be formed by adding a starter circuit 46 to the first embodiment of the present invention.

The starter circuit 46 functions to switch the pMOS transistor 36 to the conducting state before the step-up circuit 29 switches the pMOS-transistor 36 to the conducting state after power on.

Figure 6:
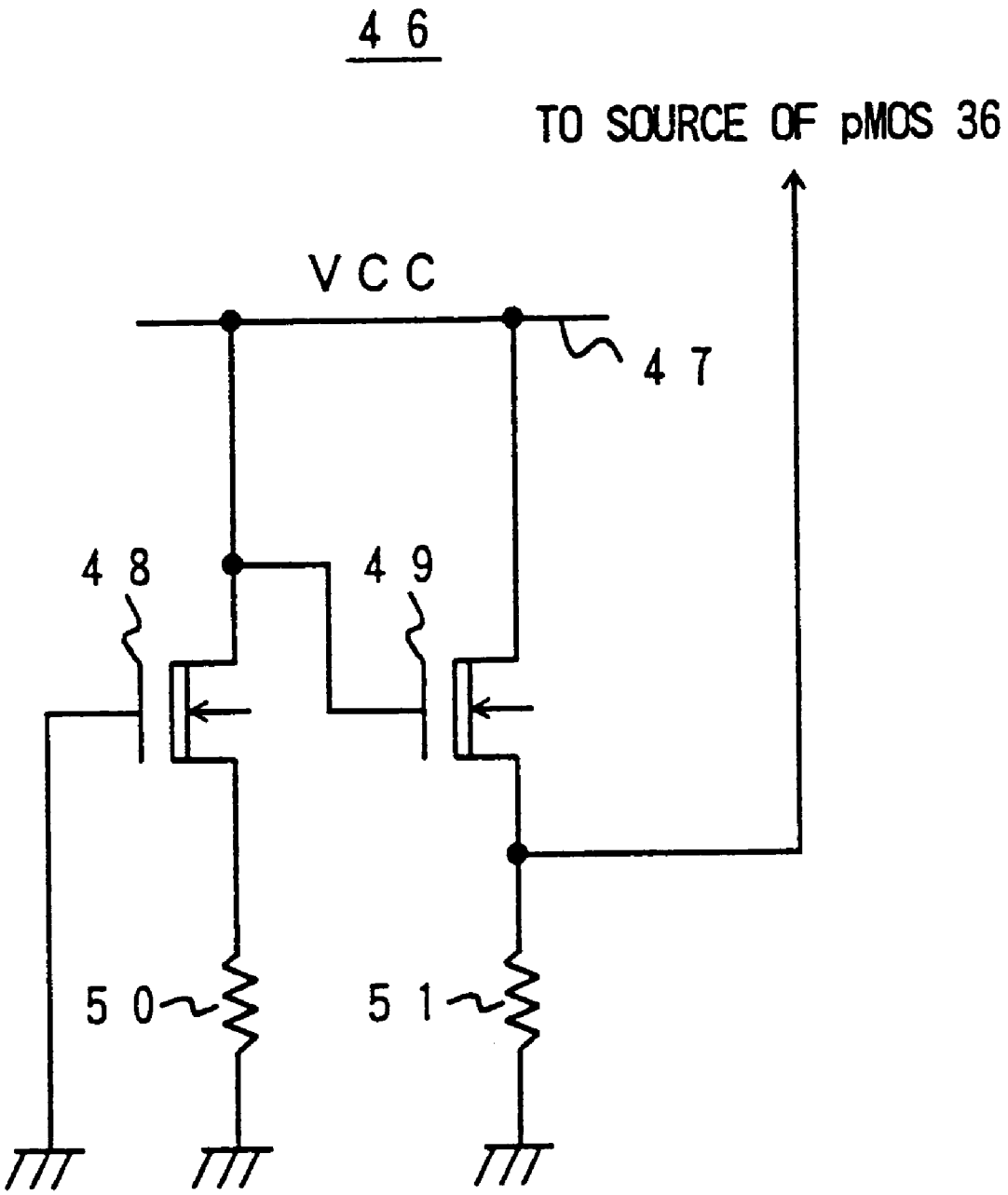
FIG. 6 is a circuit diagram of a starter circuit shown in FIG. 5.

FIG. 6 is a circuit diagram of the starter circuit 46 shown in FIG. 5. The starter circuit 46 includes a VCC power supply line 47, depletion type nMOS transistors 48 and 49, and resistors 50 and 51.

In the normal operation of the second embodiment of the present invention, the starter circuit 46 outputs the voltage equal to $2\times|VTH_{n-D}|$ upon power on. This voltage is applied to the source of the pMOS transistor 36, which is hence switched to the conducting state. Finally, the reference voltage VREF becomes equal to $2\times VTH_{n-E}+2\times|VTH_{n-D}|$, and the step-up voltage VIIB equal to $VREF+|VTH_{p-E}|+|VTH_{n-D}|$ is supplied to the reference voltage generating circuit 21 as the power supply voltage.

As described above, in the normal operation, the reference voltage generating circuit 21 is operated by the power supply voltage that is the step-up voltage VIIB equal to $VREF+|VTH_{p-E}|+|VTH_{n-D}|$ and lower than the external power supply voltage VCC.

Hence, even with the second embodiment of the present invention, it becomes possible to avoid the unstable operation due to insufficiency of the breakdown voltage for the gate oxide films of the nMOS transistors 27 and 28 even when the gate oxide films of the transistors 25–28 forming the reference voltage generating circuit 21 are formed by the same process as the gate oxide films of the nMOS transistors forming the internal circuit 43 which is operated by the step-down voltage VIIA. Hence, it becomes possible to ensure the stable operation of the reference voltage generating circuit 21.

In the second embodiment of the present invention, the pMOS transistor 36 can be switched to the non-conducting state by applying the external power supply voltage VCC to the pad 38, so that the reference voltage generating circuit 21 can be switched to the non-conducting state. Hence, it becomes possible to supply, in the test operation, the non-inverting input terminal of the operational amplifier 42 of the step-down circuit 39 with the reference voltage lower than the reference voltage VREF output by the reference voltage generating circuit 21.

Figure 7:
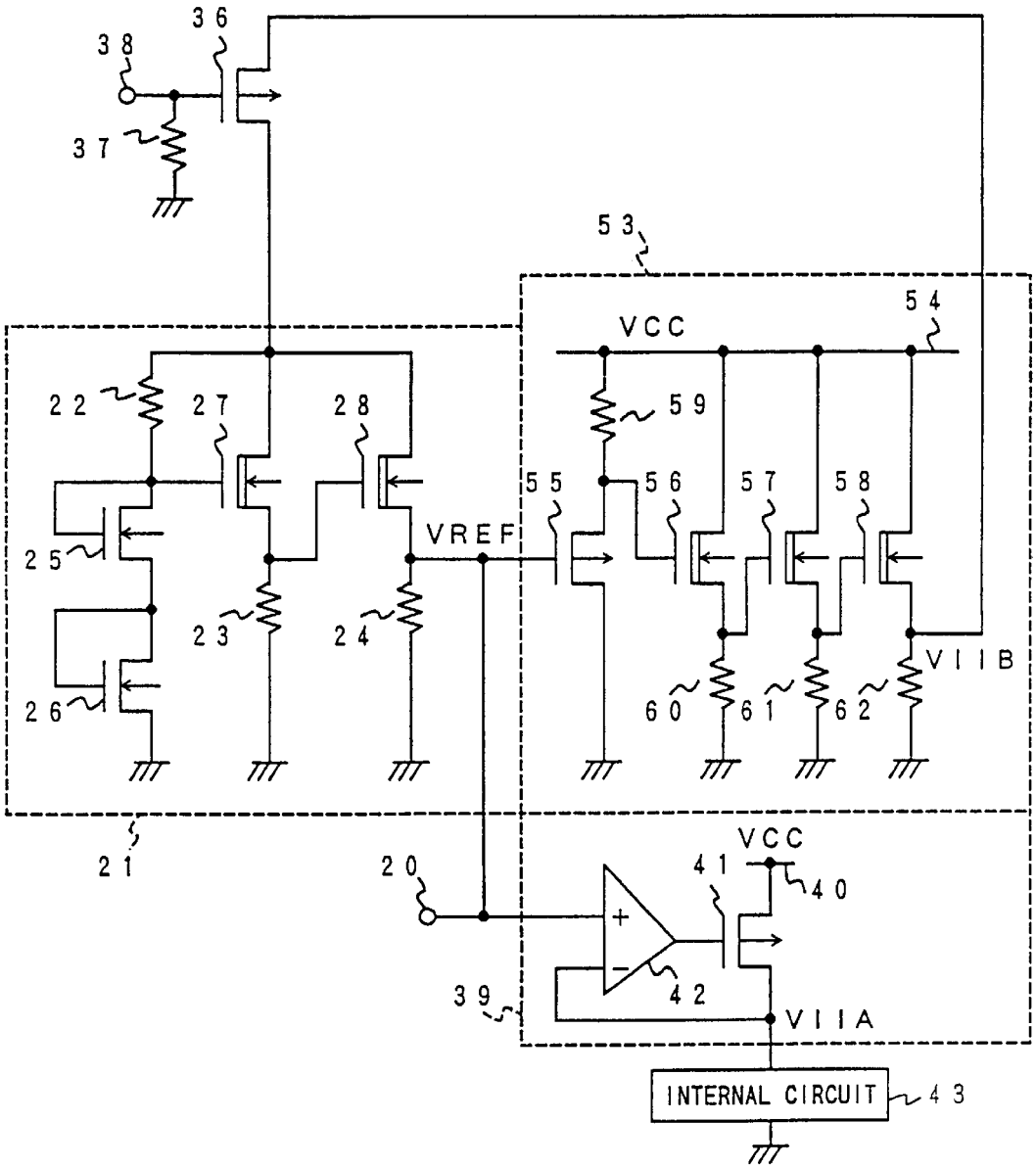
FIG. 7 is a circuit diagram of a semiconductor integrated circuit device according to a third embodiment of the present invention.

A description will now be given of a third embodiment of the present invention. FIG. 7 is a circuit diagram of an essential part of a semiconductor integrated circuit device according to the third embodiment of the present invention. In FIG. 7, parts that are the same as those shown in the previously described figures are given the same reference numbers.

The third embodiment of the present invention is the same as the first embodiment thereof except that a step-up circuit 53 having a configuration different from that of the step-up circuit 29 shown in FIG. 3 is provided instead of the step-up circuit 29.

The step-up circuit 53 shown in FIG. 7 is made up of a VCC power supply line 54, an enhancement type pMOS transistor 55, depletion type nMOS transistors 56 through 58, and resistors 59–62. In the normal operation of the device shown in FIG. 7, the reference voltage VREF becomes equal to $2\times VTH_{n-E}+2\times|VTH_{n-D}|$, and the step-up voltage VIIB becomes equal to $VREF+|VTH_{p-E}|+3\times|VTH_{n-D}|$.

Hence, it becomes possible to avoid the unstable operation due to insufficiency of the breakdown voltage for the gate oxide films of the nMOS transistors 27 and 28 even when the gate oxide films of the transistors 25–28 forming the reference voltage generating circuit 21 are formed by the same process as the gate oxide films of the nMOS transistors forming the internal circuit 43 which is operated by the step-down voltage VIIA. Hence, it becomes possible to ensure the stable operation of the reference voltage generating circuit 21.

In the third embodiment of the present invention, the pMOS transistor 36 can be switched to the non-conducting state by applying the external power supply voltage VCC to the pad 38, so that the reference voltage generating circuit 21 can be switched to the non-conducting state. Hence, it becomes possible to supply, in the test operation, the non-inverting input terminal of the operational amplifier 42 of the step-down circuit 39 with the reference voltage lower than the reference voltage VREF output by the reference voltage generating circuit 21.

Figure 8:
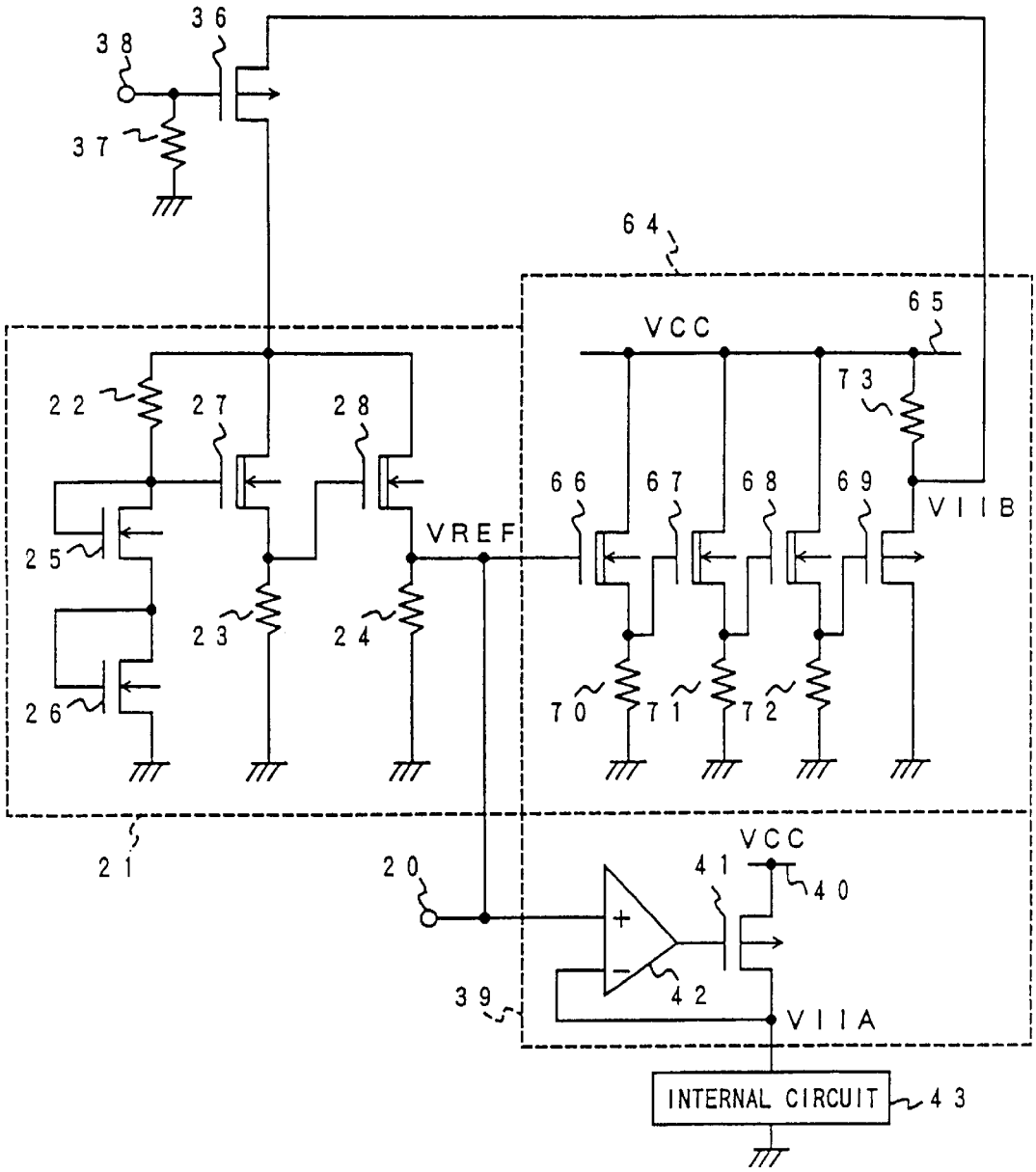
FIG. 8 is a circuit diagram of a semiconductor integrated circuit device according to a fourth embodiment of the present invention.

A description will now be given of a fourth embodiment of the present invention of the present invention. FIG. 8 is a circuit diagram of an essential part of a semiconductor integrated circuit device according to the fourth embodiment of the present invention. In FIG. 8, parts that are the same as those shown in the previously described figures are given the same reference numbers.

The fourth embodiment of the present invention is the same as the first embodiment thereof except that a step-up circuit 64 having a configuration different from that of the step-up circuit 29 shown in FIG. 3 is provided instead of the step-up circuit 29.

The step-up circuit 64 shown in FIG. 8 is made up of a VCC power supply line 65, depletion type nMOS transistors 66 through 68, an enhancement type PMOS transistor 69, and resistors 70 through 73. In the normal operation of the device shown in FIG. 8, the reference voltage VREF becomes equal to $2\times VTH_{n-E}+2\times|VTH_{n-D}|$, and the step-up voltage VIIB becomes equal to $VREF+3\times|VTH_{n-D}|+|VTH_{p-E}|$.

Hence, it becomes possible to avoid the unstable operation due to insufficiency of the breakdown voltage for the gate oxide films of the nMOS transistors 27 and 28 even when the gate oxide films of the transistors 25–28 forming the reference voltage generating circuit 21 are formed by the same process as the gate oxide films of the nMOS transistors forming the internal circuit 43 which is operated by the step-down voltage VIIA. Hence, it becomes possible to ensure the stable operation of the reference voltage generating circuit 21.

In the fourth embodiment of the present invention, the pMOS transistor 36 can be switched to the non-conducting state by applying the external power supply voltage VCC to the pad 38, so that the reference voltage generating circuit 21 can be switched to the non-conducting state. Hence, it becomes possible to supply, in the test operation, the non-inverting input terminal of the operational amplifier 42 of the step-down circuit 39 with the reference voltage lower than the reference voltage VREF output by the reference voltage generating circuit 21.

Figure 9:
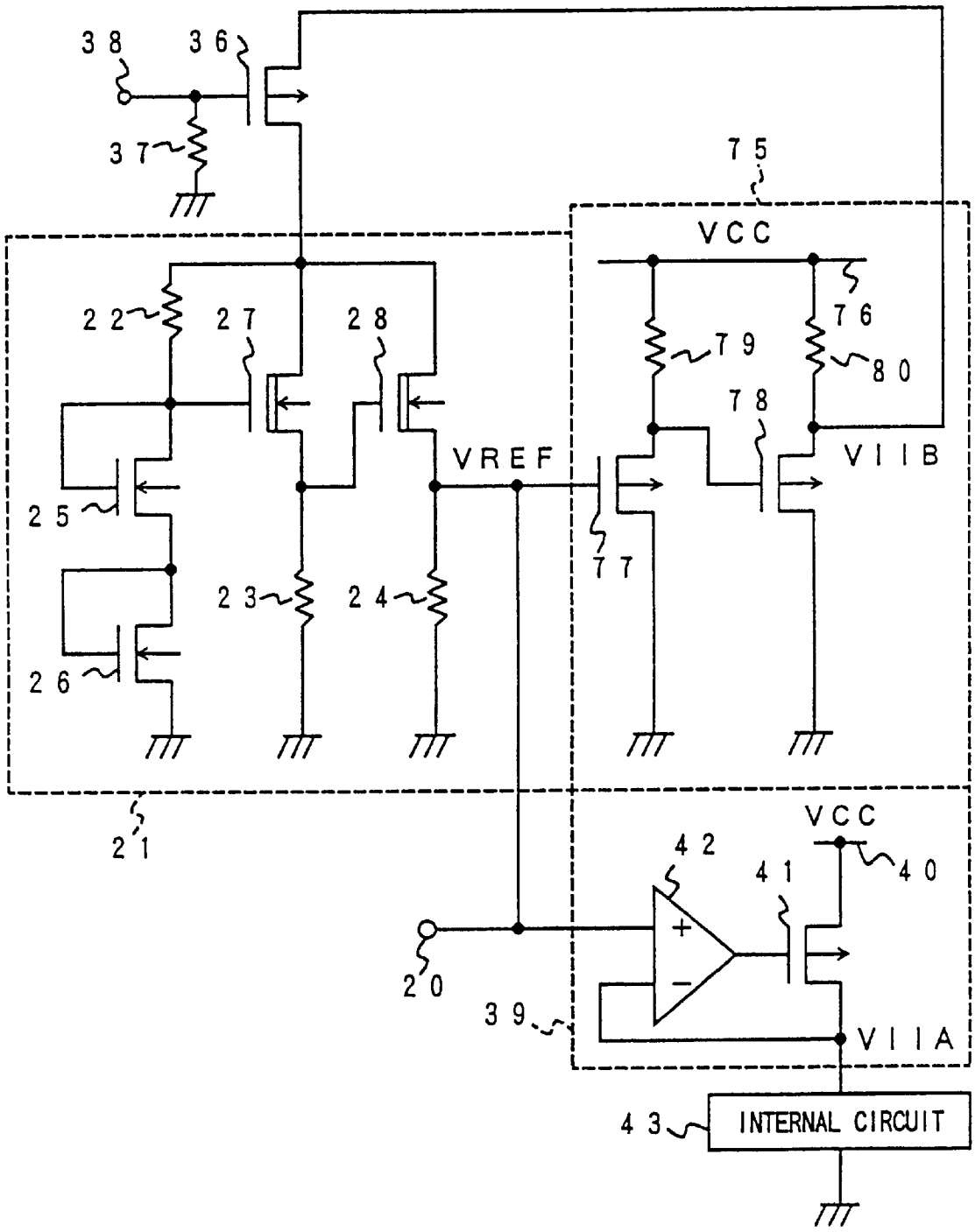
FIG. 9 is a circuit diagram of a semiconductor integrated circuit device according to a fifth embodiment of the present invention.

A description will now be given of a fifth embodiment of the present invention of the present invention. FIG. 9 is a circuit diagram of an essential part of a semiconductor integrated circuit device according to the fourth embodiment of the present invention. In FIG. 9, parts that are the same as those shown in the previously described figures are given the same reference numbers.

The fifth embodiment of the present invention is the same as the first embodiment thereof except that a step-up circuit 75 having a configuration different from that of the step-up circuit 29 shown in FIG. 3 is provided instead of the step-up circuit 29.

The step-up circuit 75 shown in FIG. 9 is made up of a VCC power supply line 76, enhancement type pMOS transistors 77 and 78, and resistors 79 and 80. In the normal operation of the device shown in FIG. 9, the reference voltage VREF becomes equal to $2\times VTH_{n-E}+2\times|VTH_{n-D}|$, and the step-up voltage VIIB becomes equal to $VREF+2\times|VTH_{p-E}|$.

Hence, it becomes possible to avoid the unstable operation due to insufficiency of the breakdown voltage for the gate oxide films of the nMOS transistors 27 and 28 even when the gate oxide films of the transistors 25–28 forming the reference voltage generating circuit 21 are formed by the same process as the gate oxide films of the nMOS transistors forming the internal circuit 43 which is operated by the step-down voltage VIIA. Hence, it becomes possible to ensure the stable operation of the reference voltage generating circuit 21.

In the fifth embodiment of the present invention, the PMOS transistor 36 can be switched to the non-conducting state by applying the external power supply voltage VCC to the pad 38, so that the reference voltage generating circuit 21 can be switched to the non-conducting state. Hence, it becomes possible to supply, in the test operation, the non-inverting input terminal of the operational amplifier 42 of the step-down circuit 39 with the reference voltage lower than the reference voltage VREF output by the reference voltage generating circuit 21.

Figure 10:
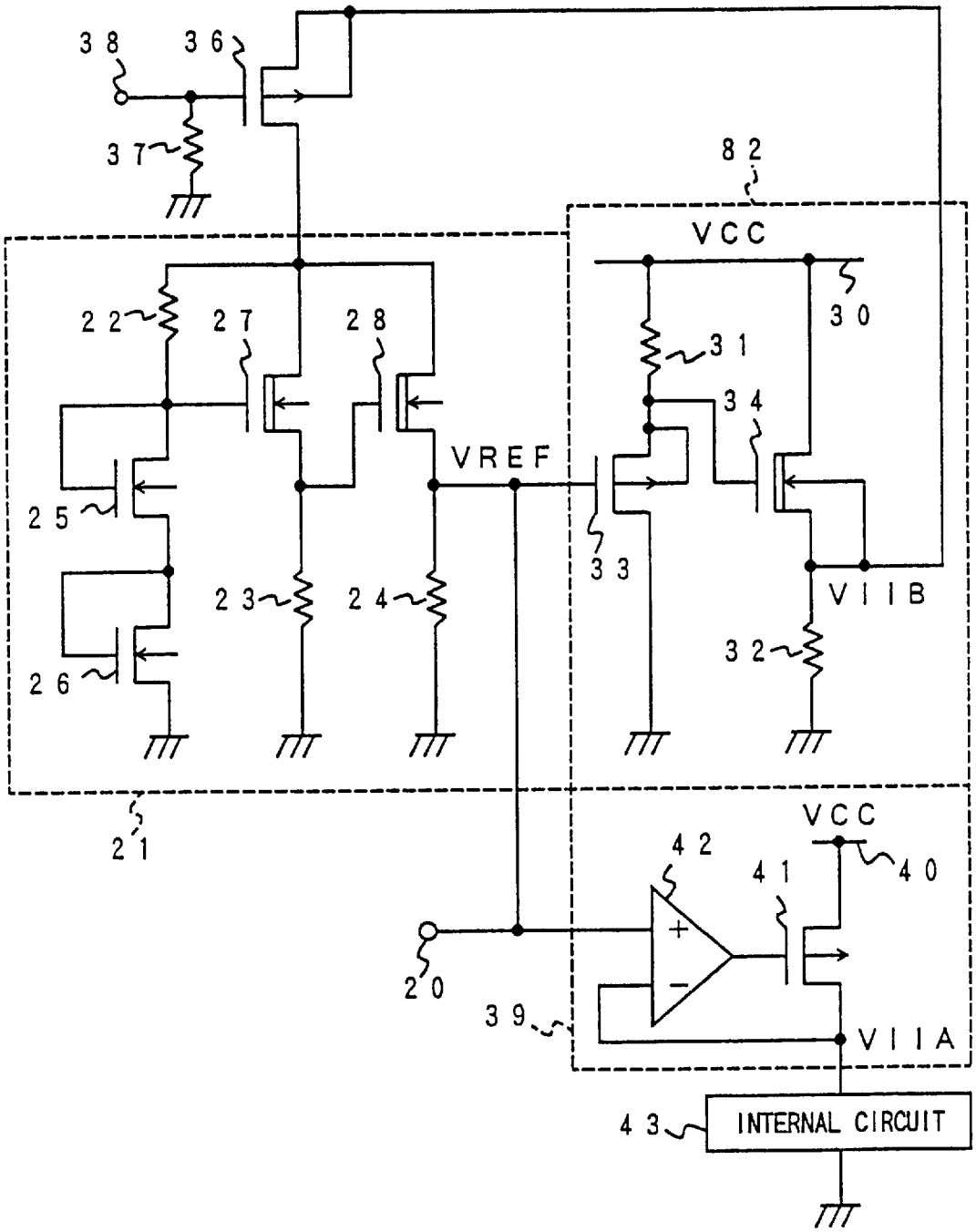
FIG. 10 is a circuit diagram of a semiconductor integrated circuit device according to a sixth embodiment of the present invention.

A description will now be given of a sixth embodiment of the present invention of the present invention. FIG. 10 is a circuit diagram of an essential part of a semiconductor integrated circuit device according to the sixth embodiment of the present invention. In FIG. 10, parts that are the same as those shown in the previously described figures are given the same reference numbers.

The sixth embodiment of the present invention is the same as the first embodiment thereof except that a step-up circuit 82 having a configuration different from that of the step-up circuit 29 shown in FIG. 3 is provided instead of the step-up circuit 29.

The step-up circuit 82 shown in FIG. 10 is configured so that the back bias voltage for the pMOS transistor 33 becomes equal to the source voltage thereof, and the back bias voltage for the nMOS transistor 34 becomes equal to the source voltage thereof. The other parts of the step-up circuit 82 are the same as those of the step-up circuit 29.

Further, the back bias voltage of the PMOS transistor 36 is made equal to the source voltage thereof, and the other parts of the sixth embodiment are the same as those of the first embodiment thereof.

In the normal operation of the device shown in FIG. 10, the reference voltage VREF becomes equal to $2\times VTH_{n-E}+2\times|VTH_{n-D}|$, and the step-up voltage VIIB becomes equal to $VREF+|VTH_{p-E}|$30 $|VTH_{n-D}|$.

Hence, it becomes possible to avoid the unstable operation due to insufficiency of the breakdown voltage for the gate oxide films of the nMOS transistors 27 and 28 even when the gate oxide films of the transistors 25–28 forming the reference voltage generating circuit 21 are formed by the same process as the gate oxide films of the nMOS transistors forming the internal circuit 43 which is operated by the step-down voltage VIIA. Hence, it becomes possible to ensure the stable operation of the reference voltage generating circuit 21.

In the sixth embodiment of the present invention, the pMOS transistor 36 can be switched to the non-conducting state by applying the external power supply voltage VCC to the pad 38, so that the reference voltage generating circuit 21 can be switched to the non-conducting state. Hence, it becomes possible to supply, in the test operation, the non-inverting input terminal of the operational amplifier 42 of the step-down circuit 39 with the reference voltage lower than the reference voltage VREF output by the reference voltage generating circuit 21.

Figure 11:
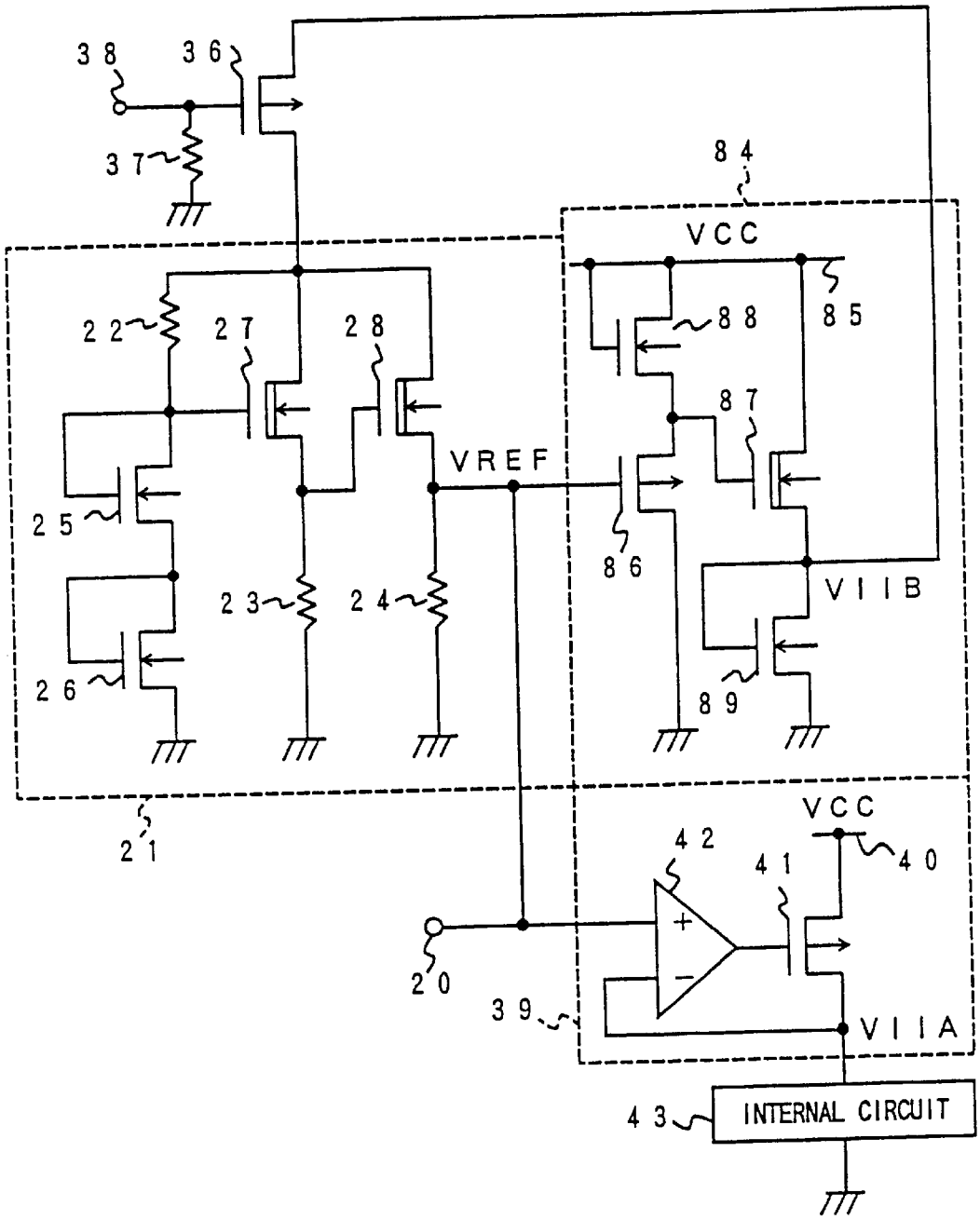
FIG. 11 is a circuit diagram of a semiconductor integrated circuit device according to a seventh embodiment of the present invention.

A description will now be given of a seventh embodiment of the present invention of the present invention. FIG. 11 is a circuit diagram of an essential part of a semiconductor integrated circuit device according to the seventh embodiment of the present invention. In FIG. 11, parts that are the same as those shown in the previously described figures are given the same reference numbers.

The seventh embodiment of the present invention is the same as the first embodiment thereof except that a step-up circuit 84 having a configuration different from that of the step-up circuit 29 shown in FIG. 3 is provided instead of the step-up circuit 29.

The step-up circuit 84 shown in FIG. 11 is made up of a VCC power supply line 85, an enhancement type pMOS transistor 86, a depletion type nMOS transistor 87, and enhancement type nMOS transistors 88 and 89. The transistors 88 and 89 function as resistors.

In the normal operation of the device shown in FIG. 8, the reference voltage VREF becomes equal to $2\times VTH_{n-E}+2\times|VTH_{n-D}|$, and the step-up voltage VIIB becomes equal to $VREF+|VTH_{p-E}|+|VTH_{n-D}|$.

Hence, it becomes possible to avoid the unstable operation due to insufficiency of the breakdown voltage for the gate oxide films of the nMOS transistors 27 and 28 even when the gate oxide films of the transistors 25–28 forming the reference voltage generating circuit 21 are formed by the same process as the gate oxide films of the nMOS transistors forming the internal circuit 43 which is operated by the step-down voltage VIIA. Hence, it becomes possible to ensure the stable operation of the reference voltage generating circuit 21.

In the seventh embodiment of the present invention, the pMOS transistor 36 can be switched to the non-conducting state by applying the external power supply voltage VCC to the pad 38, so that the reference voltage generating circuit 21 can be switched to the non-conducting state. Hence, it becomes possible to supply, in the test operation, the non-inverting input terminal of the operational amplifier 42 of the step-down circuit 39 with the reference voltage lower than the reference voltage VREF output by the reference voltage generating circuit 21.

A description will now be given of an eighth embodiment of the present invention related to the reference voltage. In order to facilitate better understanding of the eighth embodiment of the present invention, a description will now be given of a synchronous DRAM (Dynamic Random Access Memory) device externally supplied with the reference voltage.

The semiconductor devices can be reliably operated if the reference voltage applied to various internal circuits is stable. Particularly, the synchronous DRAM device handles fine signals, as compared with other semiconductor devices. For this reason, it is required that the synchronous DRAM be supplied with the very stable reference voltage to be applied to the internal circuits.

Figure 12:
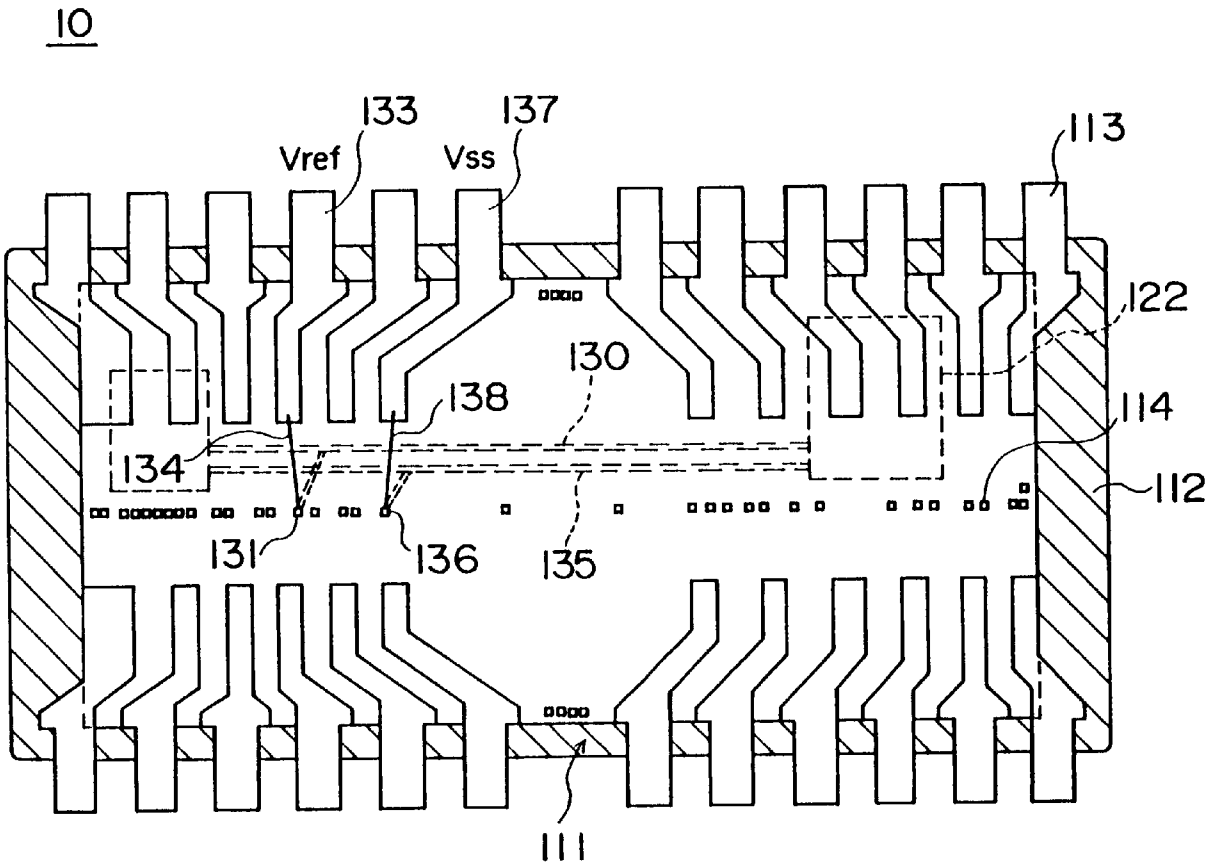
FIG. 12 is a plan view of a synchronous dynamic random access memory device related to an eighth embodiment of the present invention.

FIG. 12 is a plan view of a synchronous DRAM device 110 related to the eighth embodiment of the present invention, in which an upper package of the synchronous DRAM device 110 has been omitted therefrom. The synchronous DRAM device 110 includes a synchronous DRAM chip 111, a package 112 for hermetically sealing the chip 111, and a plurality of leads 113. A plurality of pads 114 are arranged on the chip 111. There are provided wires (not shown) electrically connecting the leads 113 and the pads 114 together.

Figure 13:
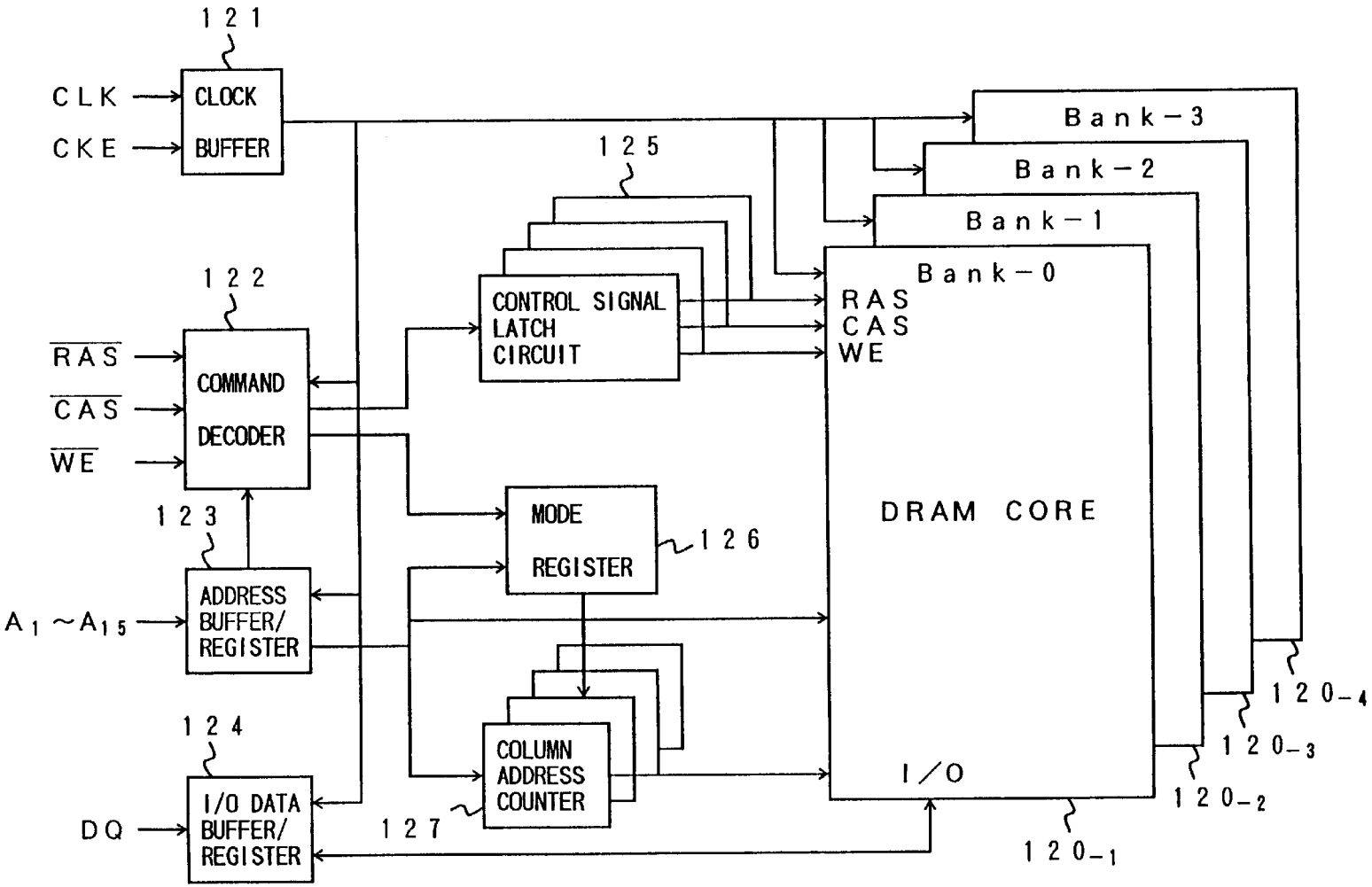
FIG. 13 is a block diagram of the synchronous dynamic random access memory device.

The chip 111 has a circuit configuration as shown in FIG. 13. The circuit configuration shown in FIG. 13 includes four DRAM cores $\mathbf{120}_{-1}$ through $\mathbf{120}_{-4}$, a clock buffer 121, a command decoder 122, an address buffer/register 123 (receiving address bits $A_0$–$A_{15}$), an I/O data buffer/register 124 (receiving and outputting data DQ), control signal latch circuits 125, a mode register 126, and column address counters 127. The clock buffer 121 externally receives clock signals CLK and CKE.

An address or data signal is transferred in synchronism with the rising edge of the clock signal CKE externally supplied, and the data write/read operation on the DRAM cores $\mathbf{120}_{-1}$–$\mathbf{120}_{-4}$ is performed by means of the circuits 121 through 127.

Turning to FIG. 12 again, the device has a reference voltage supply pattern 130, which is extended from a pad 131 and is connected to the command decoder 122 and other circuits. A $V_{ref}$ input lead 133 is connected to the pad 131 by a wire 134. A pattern 135 extends from a pad 136, and runs along the reference voltage supply pattern 130. The pattern 135 is connected to the command decoder 122. A Vss (external ground level) input lead 137 is connected to the pad 136 via a wire 138.

The synchronous DRAM device 110 is mounted on a printed circuit board (not show for the sake of simplicity), and is electrically connected to another electronic device. The external reference voltage Vref set outside of the device 110 is applied to the pattern 130 via the lead 133, so that the potential of the pattern 130 becomes equal to the reference voltage Vref. The voltage of the external ground level set outside of the device 110 is applied to the pattern 135 via the lead 133, and the potential of the pattern 135 becomes equal to the external ground level Vss.

The external ground level Vss is relatively stable. Hence, the pattern 135 functions to shield the pattern 130, and the potential Vref of the pattern 130, that is, the potential Vref of the pattern 130 with respect to the pattern 135 can be kept stable. The reason why the potential of the pattern 130 must be kept stable is that the potential of the pattern 130 is the reference potential necessary to determine whether an external control signal externally supplied to a signal terminal of the device 110, such as a row address strobe signal/RAS, a column address strobe signal/CAS or a write enable signal/WE, is "1" or "0". The reason why the potential of the pattern 130 with respect to the potential of the pattern 135 can be kept stable is that the level of the external control signals is determined with respect to the external ground level Vss.

Figure 14:
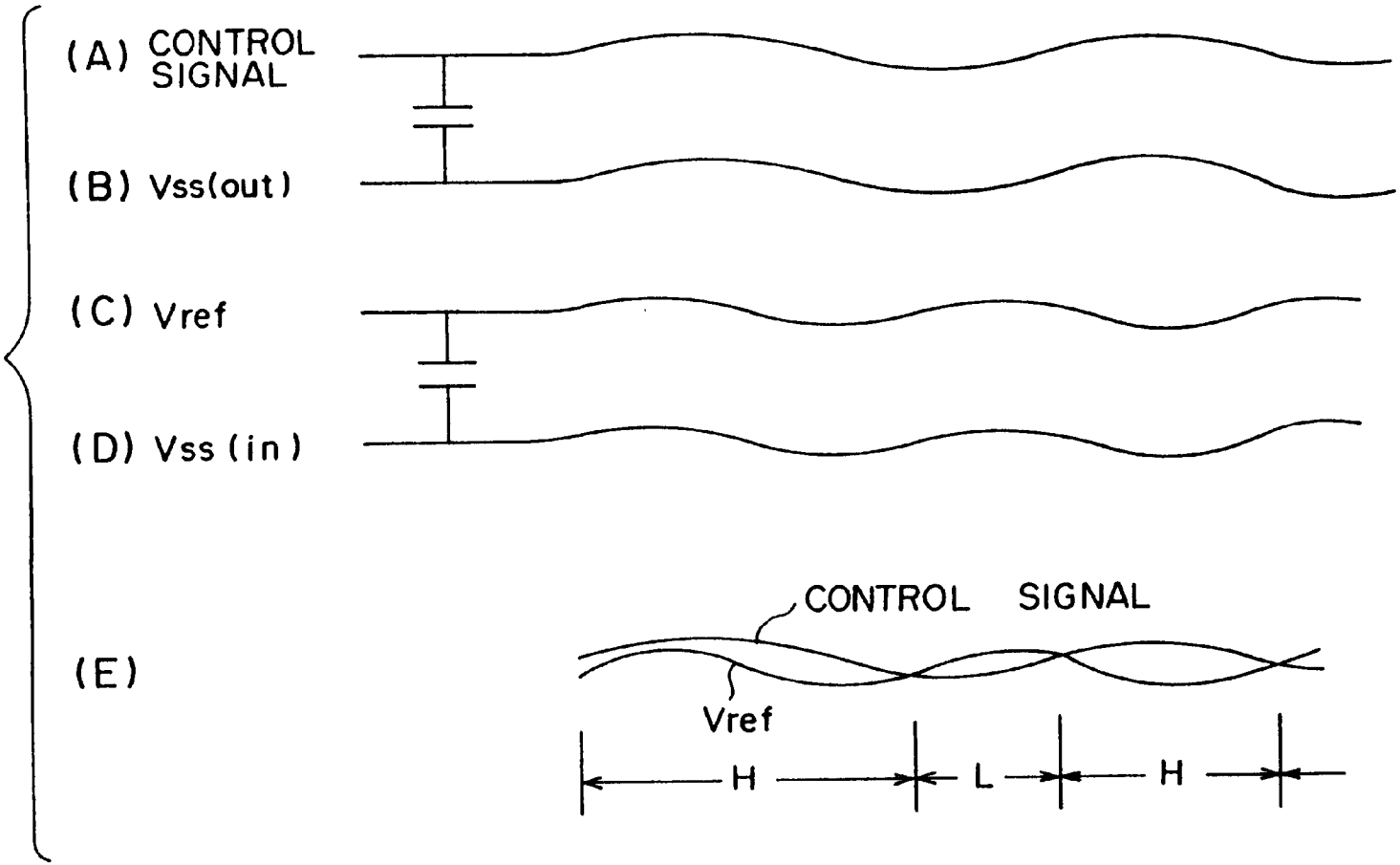
FIG. 14 is a waveform diagram of the operation of the synchronous dynamic random access memory device shown in FIG. 12.

The external ground level Vss(out) is stable as shown in part (B) of FIG. 14. Hence, the potential of an external control signal shown in part (A) of FIG. 14 is also stable. It will be noted that (out) denotes the outside of the synchronous DRAM device 110, and (in) which will be described later denotes the inside of the synchronous DRAM device 110.

The external control signals are compared with the reference voltage Vref by means of, for example, the command decoder 122 on the chip 111. In this case, it is necessary for the high level of the external control signals to be always higher than the reference voltage Vref.

However, the internal ground level Vss(in) obtained on the chip ill may be varied due to the internal operation of the chip 111, as shown in part (D) of FIG. 14. In order to reduce the influence of the variation in the external ground level Vss, a capacitor may be provided between the pattern 135 and the pattern 130 so that the potential of the pattern 130 can be stable with respect to the potential of the pattern 135. However, the variation in the internal ground level Vss(in) causes a variation in the reference voltage Vref, as shown in part (C) of FIG. 14.

As a result, the potential of the control signals obtained on the chip 111 will be changed with respect to the reference voltage Vref, as shown in part (E) of FIG. 14. The high level of the control signal originally needs to be higher than the reference voltage Vref. Nevertheless, the high level of the control signal sometimes may become lower than the reference voltage Vref. This causes the synchronous DRAM device 110 to operate unstably.

The eighth embodiment of the present invention is intended to overcome the above disadvantages.

Figure 15:
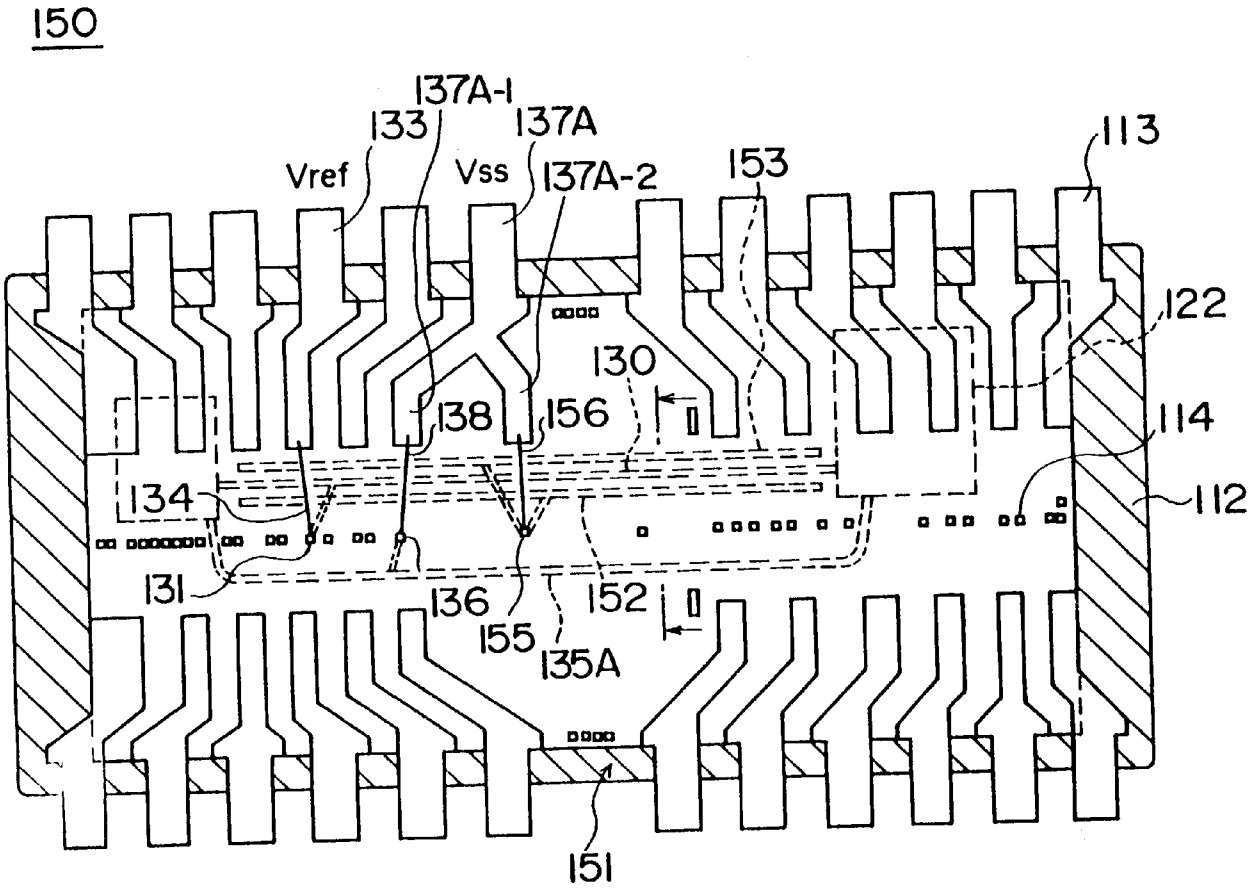
FIG. 15 is a plan view of a synchronous dynamic random access memory device according to the eighth embodiment of the present invention.
Figure 16:
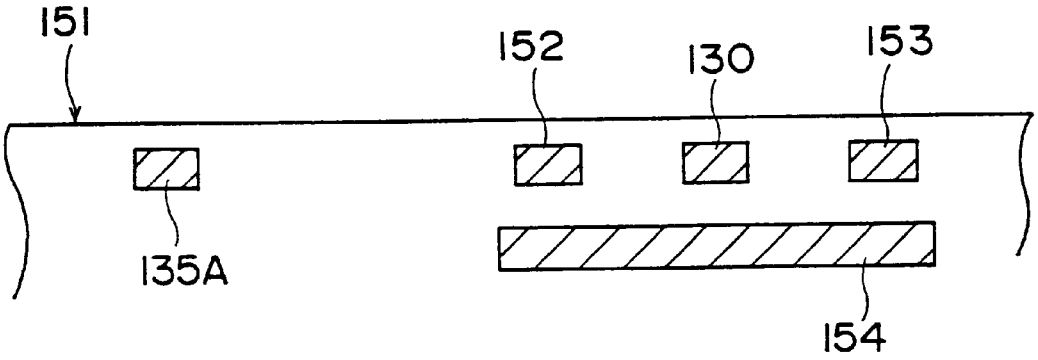
FIG. 16 is a cross-sectional view taken along line II—II shown in FIG. 15.

FIG. 15 is a plan view of a synchronous DRAM device 150 according to the eighth embodiment of the present invention. In FIG. 15, parts that are the same as those shown in FIG. 12 are given the same reference numbers. FIG. 16 is a cross-sectional view taken along line II—II in FIG. 15.

The synchronous DRAM device 150 includes a synchronous DRAM chip 151. As shown in FIGS. 15 and 16, line-shaped patterns 152 and 153 and a belt-shaped pattern 154 are formed in the synchronous DRAM chip 151. These patterns 152, 153 and 154 are special patterns functioning as shield patterns. The patterns 152, 153 and 154 are not connected to the first stages of circuits formed in the chip 151, but are connected to a special pad 155. The lines-shaped patterns 152 and 153 extend on both sides of the pattern 130. The belt-shaped pattern 154 extends beneath the pattern 130 over which the reference voltage is carried. It can be seen from the above description that the patterns 152, 153 and 154 are provided so that these patterns cover the three sides of the pattern 130.

Further, the patterns 152, 153 and 154 are electrically isolated from a belt-shaped pattern 135A. The pattern 135A is connected to the pad 136, and is located spaced apart from the pattern 130 and the patterns 152, 153 and 154. Further, the pattern 135A is connected to a circuit of the first input stage, such as the command decoder 122.

As shown in FIG. 15, there is provided a Vss input lead 137A having two arm portions 137A$_{-1}$ and 137A$_{-2}$ branched inside the package 112. The arm portion 137A$_{-1}$ is connected to the pad 136 by means of the wire 138. The arm portion 37A$_{-2}$ is connected to the pad 155 by means of a wire 156.

The synchronous DRAM device 150 thus formed is mounted on a printed circuit board (not shown for the sake of simplicity), and is used in a state in which the synchronous DRAM device 150 is connected to other electronic circuits. The pattern 130 is supplied with the external reference voltage Vref generated outside of the device 150 via the lead 133, so that the potential of the pattern 130 is set equal to the reference voltage Vref, which is applied to the command decoder 122 and the like. The voltage Vss (also referrred to as external ground level Vss(out)) determined outside of the device 150 is introduced into the device 150 via the leads 137A and 137A$_{-2}$. The voltage Vss (external ground level Vss(out)) is applied to the patterns 152, 153 and 154 via the wire 156 and the pad 155. The potentials Vss'(out) of the patterns 152, 153 and 154 are set equal to the external ground level Vss(out). The voltage Vss(external ground level voltage Vss'(out)) is also applied to the pattern 135A via the arm portion 137A$_{-1}$ of the lead 137A and to the command decoder 122 and the like via the pattern 135A.

Figure 17:
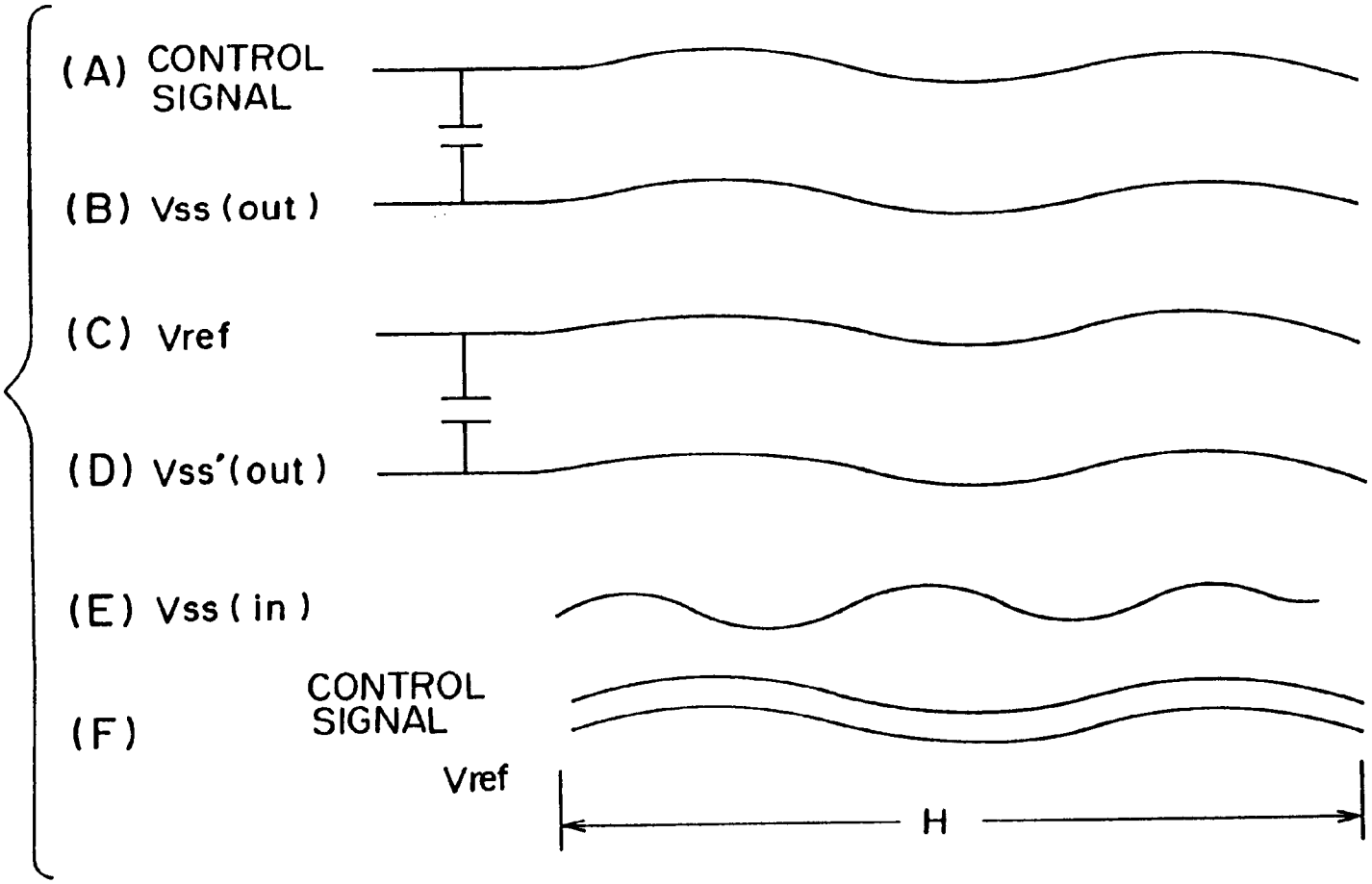
FIG. 17 is a waveform diagram of the operation of the eighth embodiment of the present invention.

In the operation of the synchronous DRAM device 150, as shown in part (E) of FIG. 17 the internal ground level Vss(in) obtained inside of the device 150 may vary due to the influence of the operation of the device 150. In contrast, the patterns 152, 153 and 154 are not connected to any circuit parts, and hence the external ground level Vss'(out) of the patterns 152, 153 and 154 is not affected by the operation of the device 150. Thus, as shown in part (D) of FIG. 17, the external ground level Vss'(out) of the patterns 152–154 varies in the same manner as the external ground level Vss(out) outside of the device 150 varies as shown in part (B) of FIG. 17.

The reference voltage Vref of the pattern 130 varies in synchronism with the external ground level Vss'(out), as shown in part (C) of FIG. 17. Further, the potential of the control signal corresponds to the external ground level Vss(out). Hence, the potential of a circuit of the first input stage (such as the command decoder 22) has a relationship with respect to the reference voltage Vref, as shown in part (F) of FIG. 17, so that the potential of the control signal can be always kept higher than the reference voltage Vref. Hence, the synchronous DRAM device 150 can normally operate without any malfunction, even when the control signals used for the synchronous DRAM device 150 have levels less than those used for other semiconductor devices.

Figure 18:
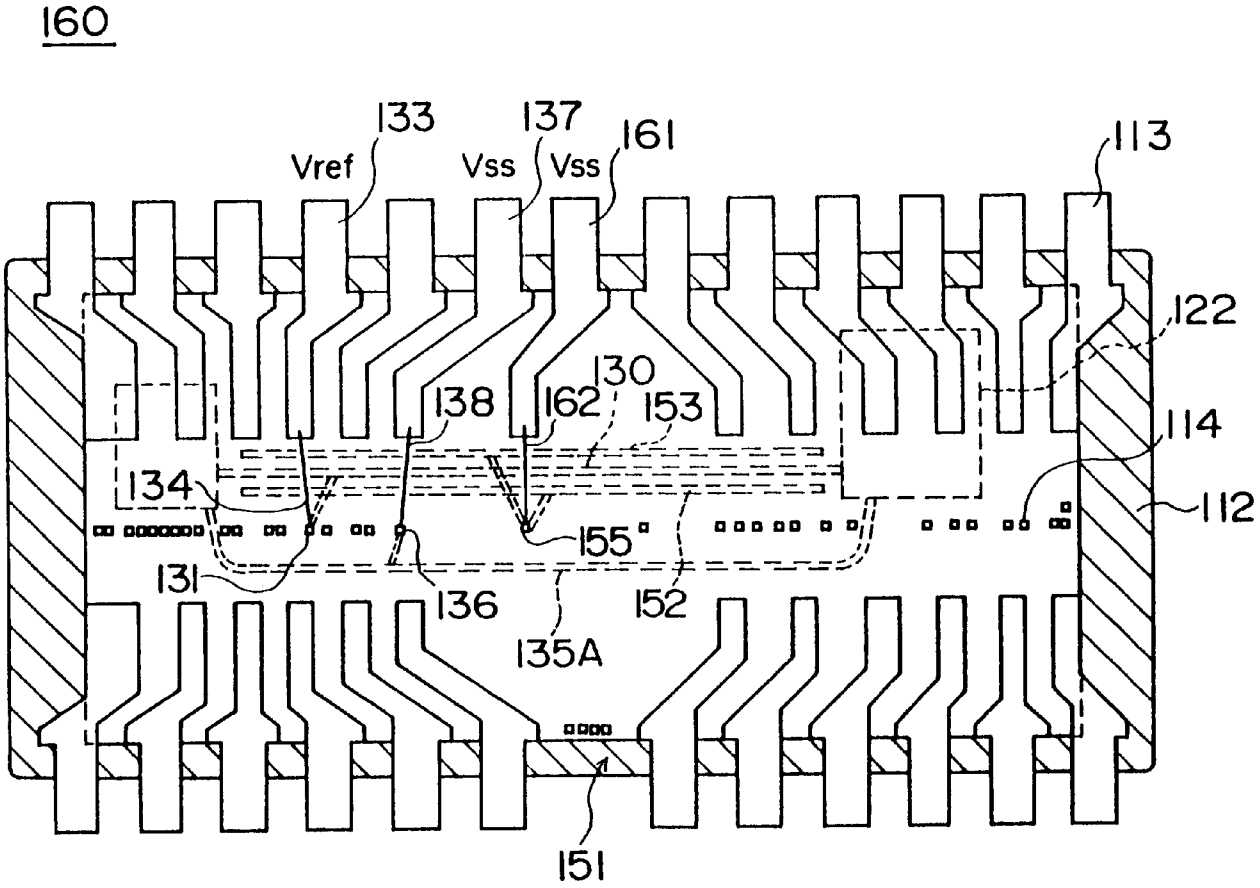
FIG. 18 is a plan view of a synchronous dynamic random access memory device according to a ninth embodiment of the present invention.

FIG. 18 is a plan view of a synchronous DRAM device 160 according to a ninth embodiment of the present invention. In FIG. 18, parts that are the same as those shown in FIG. 15 are given the same reference numbers.

The device 160 shown in FIG. 18 differs from the device shown in FIG. 15 in that a lead 161 is provided separately from the Vss input lead 137. The ground level voltage Vss(out) determined outside of the device 160 is introduced into the device 160 via the lead 161. This voltage is applied to the patterns 152, 153 and 154 via a wire 162 and the pad 155, and the potentials of the patterns 152, 153 and 154 are set to the external ground level Vss'(out) equal to the voltage Vss(out). Hence, the synchronous DRAM device 160 operates normally as in the case of the synchronous DRAM device 150.

Various variations and modifications of the eighth and ninth embodiments of the present invention can be made. For example, the voltage applied to the patterns 151, 152 and 153 for shielding the reference voltage supply pattern 130 is not limited to the external ground level Vss but may be an appropriate voltage. Further, the patterns 152, 153 and 154 can be applied to semiconductor devices other than the synchronous DRAM device.

Figure 19:
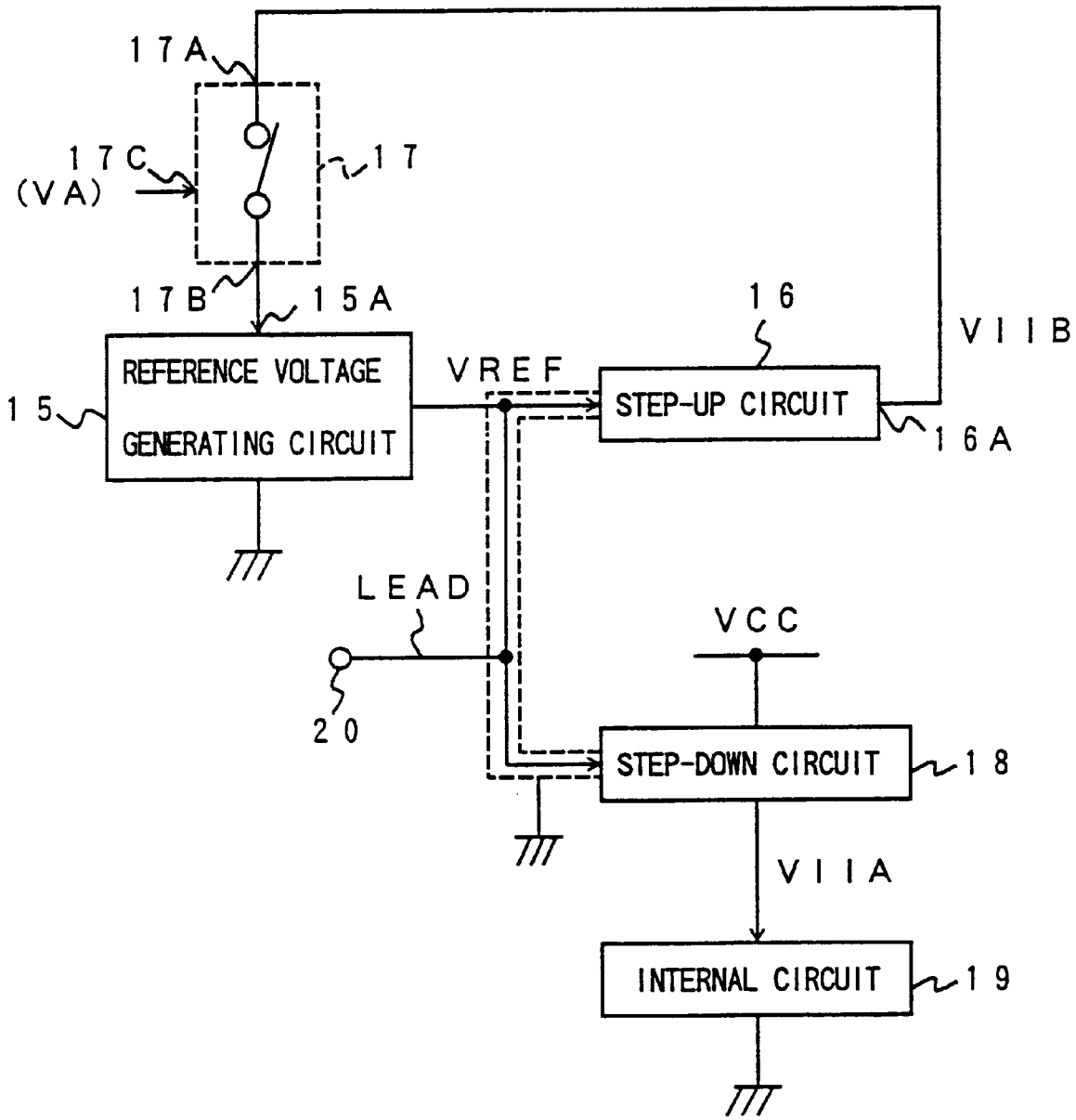
FIG. 19 is a block diagram of an application in which the eighth or ninth embodiment of the present invention is applied to the first embodiment thereof.

The eighth and ninth embodiments of the present invention can be applied to the first through seventh embodiments thereof, as shown in FIG. 19. The broken lines shown in FIG. 19 correspond to the shield patterns 152, 153 and 154. The shield patterns 152, 153 and 154 are provided for the line which carries the reference voltage VREF in the normal operation and carries the external reference voltage applied to the terminal 20 in the test operation. The shield patterns 152, 153 and 154 are effective in the test operation in which the external reference voltage is applied to the terminal 20 in order to test the device.

The transistors used in the aforementioned embodiments are not limited to the MOS type but other types of field effect transistors such as a MIS (Metal Insulator Semiconductor) type can be used.

The present invention is not limited to the specifically disclosed embodiments, and variations and modifications may be made without departing from the scope of the invention.

What is claimed is:

1. A semiconductor integrated circuit device comprising:

a semiconductor chip;

a reference voltage supply pattern which transmits a reference voltage externally supplied to a circuit formed on the semiconductor chip; and a voltage source pattern being arranged along said reference voltage supply pattern and having a potential externally supplied, wherein the reference voltage is varied in response to a variation in the potential at said voltage source pattern.

2. The semiconductor integrated circuit device as claimed in claim 1, wherein said semiconductor integrated circuit device is a synchronous dynamic random access memory device.

3. The semiconductor integrated circuit device as claimed in claim 1, wherein said potential at said voltage source pattern is a ground level potential.

4. The semiconductor integrated circuit device as claimed in claim 1, wherein said voltage source pattern comprises two conductor patterns which are arranged along both sides of the reference voltage supply pattern.

5. The semiconductor integrated circuit device as claimed in claim 1, wherein said voltage source pattern is not connected to any circuit parts on said semiconductor chip.

6. The semiconductor integrated circuit device as claimed in claim 1, further comprising a second voltage source pattern connected to said circuit and a first external connection terminal, said voltage source pattern connected to a second external connection terminal, wherein the voltage source pattern is electrically isolated form said second voltage source pattern on said semiconductor chip.

7. A semiconductor integrated circuit device comprising:

a semiconductor chip;

a reference voltage supply pattern which transmits a reference voltage externally supplied; and a voltage source pattern being arranged along said reference voltage supply pattern and having a potential externally supplied, and a circuit for comparing an externally supplied signal with said reference voltage to determine a logic level of said externally supplied signal.

8. The semiconductor integrated circuit device as claimed in claim 7, wherein said voltage source pattern is not connected to any circuit parts on said semiconductor chip.

9. The semiconductor integrated circuit device as claimed in claim 7, further comprising a second voltage source pattern connected to said circuit and a first external connection terminal, said voltage source pattern connected to a second external connection terminal, wherein the voltage source pattern is electrically isolated from said second voltage source pattern on said semiconductor chip.

10. The semiconductor integrated circuit device as claimed in 7, wherein a potential of said externally supplied signal is varied in response to said potential of said voltage source pattern.

* * * * *